United States Patent [19]

Heft et al.

[11] 4,431,877

[45] Feb. 14, 1984

[54] THERMAL SHIELD FOR CIRCUIT BREAKER OPERATING SPRING

[75] Inventors: Eldon B. Heft, West Hartford; Joseph B. Kelaita, Jr., Bristol, both of Conn.

[73] Assignee: General Electric Company, New York, N.Y.

[21] Appl. No.: 353,449

[22] Filed: Mar. 1, 1982

[51] Int. Cl.[3] ..... H01H 33/02

[52] U.S. Cl. ..... 200/144 R; 200/304

[58] Field of Search ..... 200/147 R, 144 R, 304, 200/305

[56] References Cited

U.S. PATENT DOCUMENTS

| | | | |
|---|---|---|---|
| 537,130 | 4/1895 | Sperry | 200/304 |
| 2,183,612 | 12/1939 | Gubin | 200/305 |
| 2,759,075 | 8/1956 | Hults | 200/304 |
| 3,123,691 | 3/1964 | Burton | 200/305 |
| 4,011,420 | 3/1977 | Heft | 200/147 R |
| 4,199,740 | 4/1980 | Woods | 200/304 |
| 4,266,210 | 5/1981 | Mrenna et al. | 200/147 R |

*Primary Examiner*—Robert S. Macon

*Attorney, Agent, or Firm*—Richard A. Menelly; Walter C. Bernkopf; Fred Jacob

[57] ABSTRACT

A thermal shield is employed with a circuit breaker operating spring to protect the spring from thermal degradation during contact arcing. One embodiment includes an ablative plastic coating on the outer surface of the shield to promote arc quenching.

10 Claims, 7 Drawing Figures

THERMAL SHIELD FOR CIRCUIT BREAKER OPERATING SPRING

BACKGROUND OF THE INVENTION

Repeated exposure of a circuit breaker operating spring to the temperatures attained during contact arcing can cause thermal degradation of the spring which changes the operating characteristics. U.S. Pat. No. 4,011,420, entitled, "Molded Case Circuit Breaker With Improved Interrupting Capacity" describes a molded case circuit breaker which includes a barrier between the arcing chamber and the operating spring along with an arc runner to assist in controlling the extinction of the arc developed incident to an interruption. This patent is incorporated herein for purposes of reference. It has been discovered that under repeated arcing conditions, some of the gases generated during contact arcing seep through the clearance provided in the barrier for contact arm motion, and carry some of the heat generated by the arc up to the operating spring. Under extreme arcing conditions, the operating spring characteristics may become altered thereby effecting the breaker tripping mechanism.

A further prior art attempt to reduce thermal degradation of the main operating spring consisted of a moveable shutter attached to the contact arm and extending over the arcing chamber. Movement of the contact arm causes the shutter to follow and provide a baffle between the arcing chamber and the operating mechanism during contact separation.

The purpose of this invention is to provide means for protecting the circuit breaker operating spring from the high temperature gases evolved during contact arcing.

SUMMARY OF THE INVENTION

The invention comprises the provision of a heat shield partially around a circuit breaker operating spring. The heat shield is secured to the circuit breaker moveable contact arm. One embodiment consists of a semi-cylindrical metal shield arranged concentrically around the operating spring. A further embodiment employs an ablative plastic coating on the exterior surface of the shield to evolve an arc quenching gas when contacted by the effluent arc gases. The ablated gases also cool the shield and, hence, protect the spring from thermal degradation. Another embodiment consists of a thermal shield fabricated from an ablative plastic material which provides both a thermal barrier as well as a quenching gas source.

DESCRIPTION OF THE PREFERRED EMBODIMENT

Figure 1:
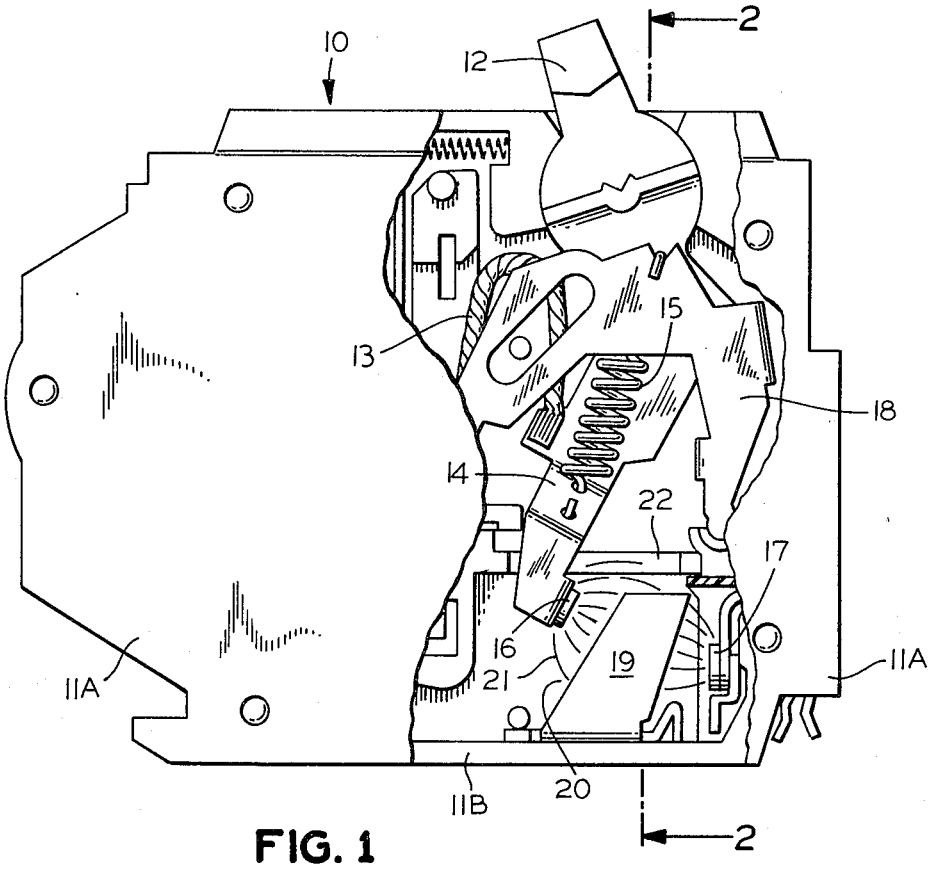
FIG. 1 is a side view of a molded case circuit breaker casing with part of the breaker mechanism exposed.
Figure 2:
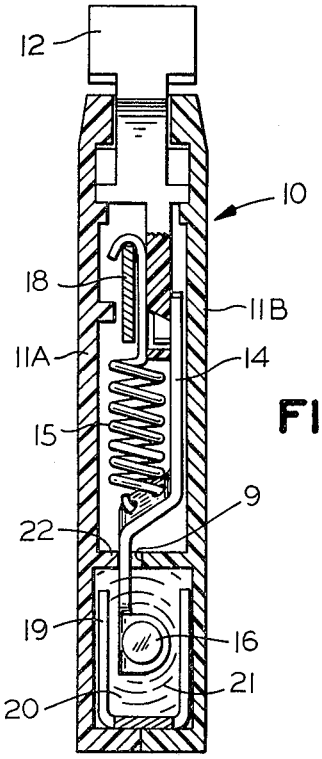
FIG. 2 is a section of the circuit breaker depicted in FIG. 1 through the plane 2—2.

A detailed description of a molded case circuit breaker is contained within the aforementioned U.S. patent. FIG. 1 shows a cutaway portion of a circuit breaker 10 similar to that disclosed within the aforementioned patent for which reference is made for a more complete explanation of the structure and operation of the components to be described herein. Circuit breaker 10 consists of a cover 11A, and base 11B made of a moldable plastic material and includes an on/off handle 12 extending through the cover for the purpose of switching the circuit breaker on and off as well as for providing a resetting function to the breaker. A copper braid 13 connects electric power to breaker contact arm 14 which carries the circuit breaker operating spring 15. At one end of contact arm 14, there is affixed a moveable contact 16 which cooperates with a fixed contact 17 for the purpose of completing the electrical circuit through the breaker. A cradle 18 is hingeably connected with contact arm 14 and an arc chute 19 is partially interposed between fixed and moveable contacts 16, 17 to provide a means for containing arc 21 which occurs when contacts 16, 17 become rapidly disengaged. An arc chamber 20 is provided beneath contacts 16, 17 in order to allow for the expansion of arc 21. A barrier 22 extends between cover 11A and base 11B to provide a means for containing arc 21 within arc chamber 20. In order to allow for the motion of contact arm 14 when contacts 16, 17 are brought in and out of engagement, a clearance 9, shown in FIG. 2, is defined within barrier 22. Clearance 9 then allows gases which become evolved by the heat generated by arc 21 to transmit up to the vicinity of contact arm 14 and operating spring 15.

Figure 3:
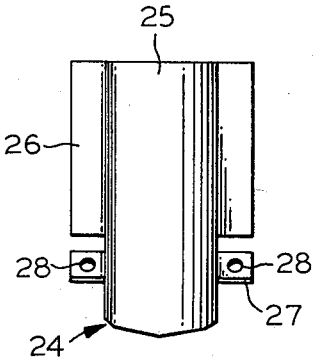
FIG. 3 is a plan view of the operating spring heat shield according to the invention.
Figure 4:
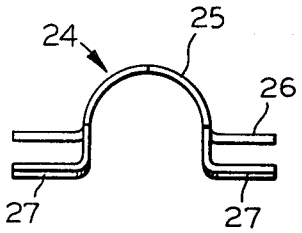
FIG. 4 is an end view of the shield depicted in FIG. 3.

FIG. 3 contains a thermal shield 24 for use with the operating spring 15 shown in FIGS. 1 and 2. A semi-cylindrical body or closure 25 fabricated from a single piece of metal contains a base portion 26 and a pair of depending tabs 27. Base 26 provides additional shielding surface while tabs 27, which include holes 28, are used for attaching shield 24 to contact arm 14. Shield 24 is shown in FIG. 4 with body member 25, base 26 and tabs 27. Base 26 extends above tab 27 to provide operative clearance for operating spring 15.

Figure 5:
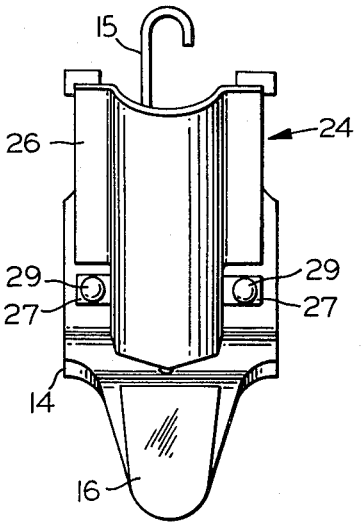
FIG. 5 is a plan view of a contact arm including the operating spring and thermal heat shield of the instant invention.
Figure 6:
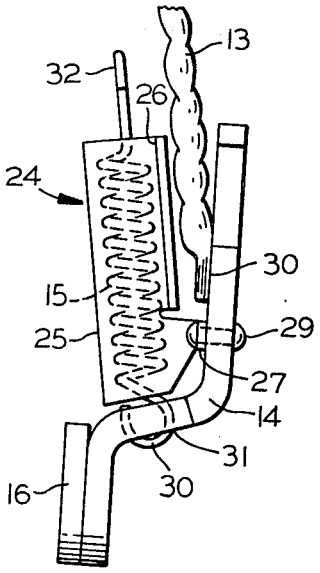
FIG. 6 is a side view of the contact arm shown in FIG. 5.
Figure 7:
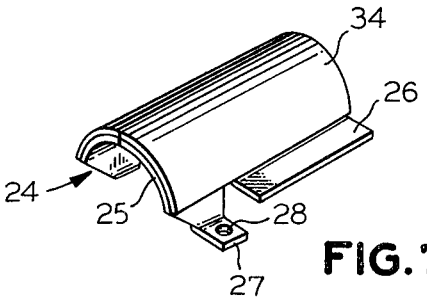
FIG. 7 is a top perspective view of the heat shield according to the invention including an ablative plastic coating.

FIG. 5 shows the arrangement of shield 24 partially encompassing operating spring 15 with shield tabs 27 fastened to contact arm 14 by means of rivets 29. Body 25 can also be directly attached to contact arm 14 by welding, if so desired. The offset relation between base 26 and tabs 27 is shown in FIG. 6 with tabs 27 held flush against the surface of contact arm 14 by means of rivets 29 and with base 26 and body 25 cantilevered from contact arm 14 at the point of contact with tabs 27. This cantilevered arrangement of shield 24 is necessitated by the change in length of operating spring 15 when contact arm 14 is pivoted between the open, tripped and closed positions of contacts 16 and 17. Braid 13 is attached to one side of contact arm 14 by means of a weld 30 whereas operating spring 15 is generally situated axially along the center line of contact arm 14. Operating spring 15 is attached to contact arm 14 by hooking spring end 30 within groove 31 as shown in FIG. 6. The opposite end 32 of spring 15 is attached to cradle 18 as shown in FIG. 2. When shield 24 is employed within the circuit breaker described in FIGS. 1 and 2, prolonged arcing can occur without deleteriously effecting operating spring 15. An additional benefit is achieved by employing an ablative coating or cover 31 on the exterior of body 25 as shown in FIG. 7. When an ablative material, such as "Delrin", which is a trademark for an acetal resin formulation becomes heated by contact with the gases generated in the vicinity of arc 21 as shown in FIGS. 1 and 2, the Delrin material abates, giving off a monolayer of compositional gases, including hydrogen, which rapidly cool the surface of body member 25 and decreases the amount of heat reaching spring 15. The gas generated during ablation also assists in quenching arc 21 as described, for example, in U.S. Pat. No. 3,632,926, assigned to the common assignee of the instant invention, and which is incorporated herein for purposes of reference. Other ablative plastic materials which are commercially available may also be employed. In some applications, the entire shield 24 can be stamped, pressed or molded from the ablative material itself to provide both the shielding and ablative cooling function. When the shield 24 depicted in FIG. 3, for example, is made from an ablative plastic material, holes 28 could be dispensed with and shield 24 can be fastened to contact arm 14 by means of a meltable adhesive such as a silicone resin or by means of ultrasonic welding.

Although the thermal shield of the invention is described for use with a one-half inch wide circuit breaker as generally shown in FIGS. 1 and 2, this is by way of example only. The inventive shield finds immediate application in circuit breakers having a width greater than one-half inch and having no arc chamber barrier whatsoever.

We claim:

1. A thermal heat shield for molded case circuit breakers comprising:

a body member at least partially encompassing a circuit breaker operating spring; and means for attaching said body member to a circuit breaker moveable contact arm, said body member being concentrically arranged on said spring.

2. A thermal heat shield for molded case circuit breakers comprising:

a body member at least partially encompassing a circuit breaker operating spring; and means for attaching said body member to a circuit breaker moveable contact arm, said attaching means comprising at least one tab depending from said body member and defining means for inserting a fastening device.

3. The thermal shield of claim 1 including a cover of an ablative material on the surface of said body for evolving gas upon the occurrence of an arc within said circuit breaker.

4. The thermal shield of claim 3 wherein the ablative coating comprises an acetal resin.

5. The thermal shield of claim 2 further including a base on both sides of said body member for providing additional shielding surface to said spring, said base extending above said tabs.

6. The thermal shield of claim 2 wherein said tabs are attached to said contact arm by means of rivets.

7. A thermal heat shield for molded case circuit breakers comprising:

a body member at least partially encompassing a circuit breaker operating spring; and means for attaching said body member to a circuit breaker moveable contact arm, said body being attached to said contact arm by means of welding.

8. The thermal shield of claim 5 wherein said body member and said base are cantilevered from said contact arm.

9. A thermal heat shield for molded case circuit breakers comprising:

a contact arm supporting a moveable contact member within a circuit breaker casing;

an operating spring carried by said arm for moving said moveable contact in and out of communication with a fixed contact; and means formed integrally with said contact arm for shielding said operating spring during separation of said fixed and moveable contacts.

10. A molded case circuit breaker comprising:

an insulative housing supporting a moveable contact arm having a contact at one end and an input and output terminals;

a fixed contact for communicating with said moveable contact to provide electrical continuity between said terminals;

an operating spring for moving said moveable contact into said communication with said fixed contact to provide said electrical continuity and for moving said moveable contact away from said fixed contact to provide circuit interruption between said terminals; and shield means proximate said operating spring to protect said operating spring from thermal degradation by arcing between said fixed and moveable contacts during said circuit interruption.

* * * * *